US006672480B1

(12) United States Patent
Miller

(10) Patent No.: US 6,672,480 B1
(45) Date of Patent: Jan. 6, 2004

(54) FLUID DISPENSING SYSTEM

(76) Inventor: Keith D. Miller, 11189 Longhill Dr., Pinellas Park, FL (US) 33782

( * ) Notice: Subject to any disclaimer, the term of this patent is extended or adjusted under 35 U.S.C. 154(b) by 17 days.

(21) Appl. No.: 10/057,278

(22) Filed: Jan. 25, 2002

(51) Int. Cl.[7] ..... B67D 5/56

(52) U.S. Cl. ..... 222/129; 222/321.7; 222/144.5; 222/181.2; 220/507; 220/483; 220/503

(58) Field of Search ..... 222/129, 136, 222/144.5, 181.2, 321.7, 321.9, 181.3; 220/483, 507, 503, 522, 524, 555, 326

(56) References Cited

U.S. PATENT DOCUMENTS 1,742,279 A * 1/1930 Reynolds ..... 206/218
2,131,687 A * 9/1938 Kaplan ..... 294/64.1
2,883,062 A * 4/1959 Rosemark ..... 211/60.1
2,919,448 A * 1/1960 Solbach ..... 4/627
4,024,731 A * 5/1977 Branscum ..... 62/457.2
4,548,339 A * 10/1985 Gorman ..... 222/129
4,592,478 A * 6/1986 Laconis ..... 220/23.83
4,611,716 A * 9/1986 Sorlien ..... 206/581
4,793,517 A * 12/1988 Washut ..... 222/129
4,969,587 A * 11/1990 Miller ..... 224/148.7
5,413,251 A * 5/1995 Adamson ..... 222/129
5,484,081 A * 1/1996 Jahn ..... 220/759
6,082,588 A * 7/2000 Markey et al. ..... 222/137
6,135,323 A * 10/2000 Chen et al. ..... 222/135

* cited by examiner

*Primary Examiner*—Gene Mancene
*Assistant Examiner*—Frederick C. Nicolas
(74) *Attorney, Agent, or Firm*—Edward P. Dutkiewicz

(57) ABSTRACT

A fluid dispensing system comprises a container in a generally rectilinear configuration with a plurality of fluid receiving zones are provided within the walls. At least one suction cup has a mounting portion coupled to the rear wall of the container and a suction portion to facilitate a holding suction force upon the pressing of the suction cup onto a flat surface. A top wall has side edges coupled to the top edges of the front, rear and side walls and with coupling regions above the fluid receiving zones. A plurality of container caps with internal female coupling regions allow the cap to be removably received and held-on the container. Cap links have a first end coupled to the caps and a second end coupled to the container.

9 Claims, 5 Drawing Sheets

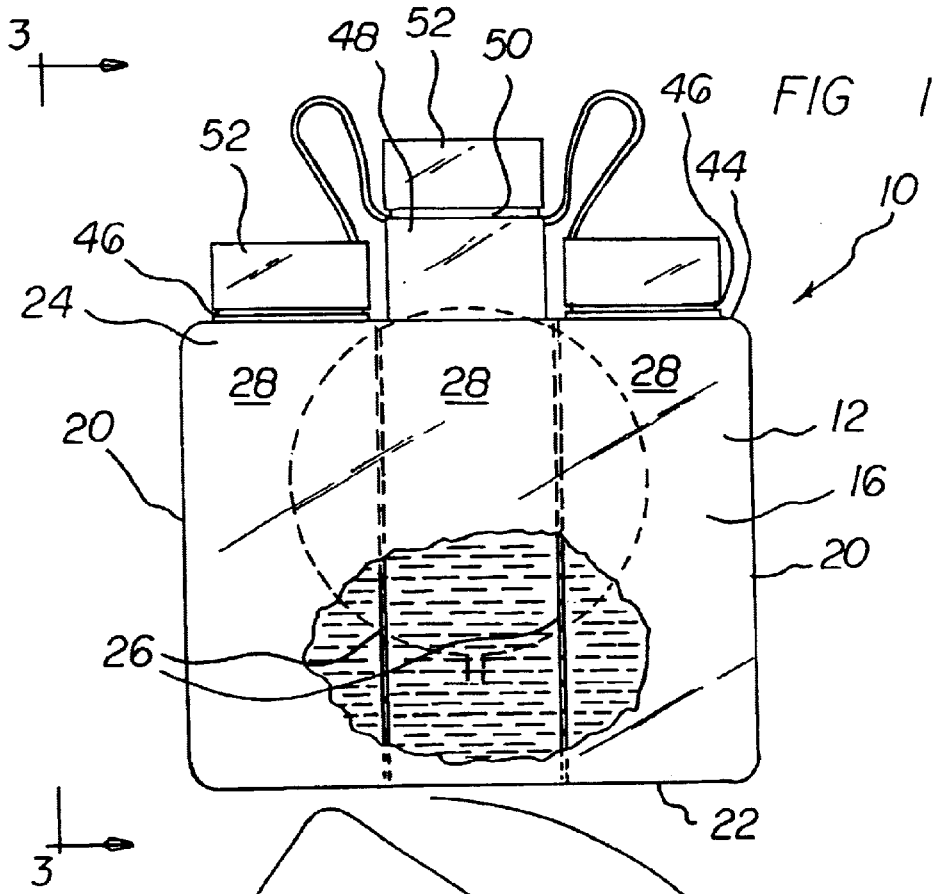
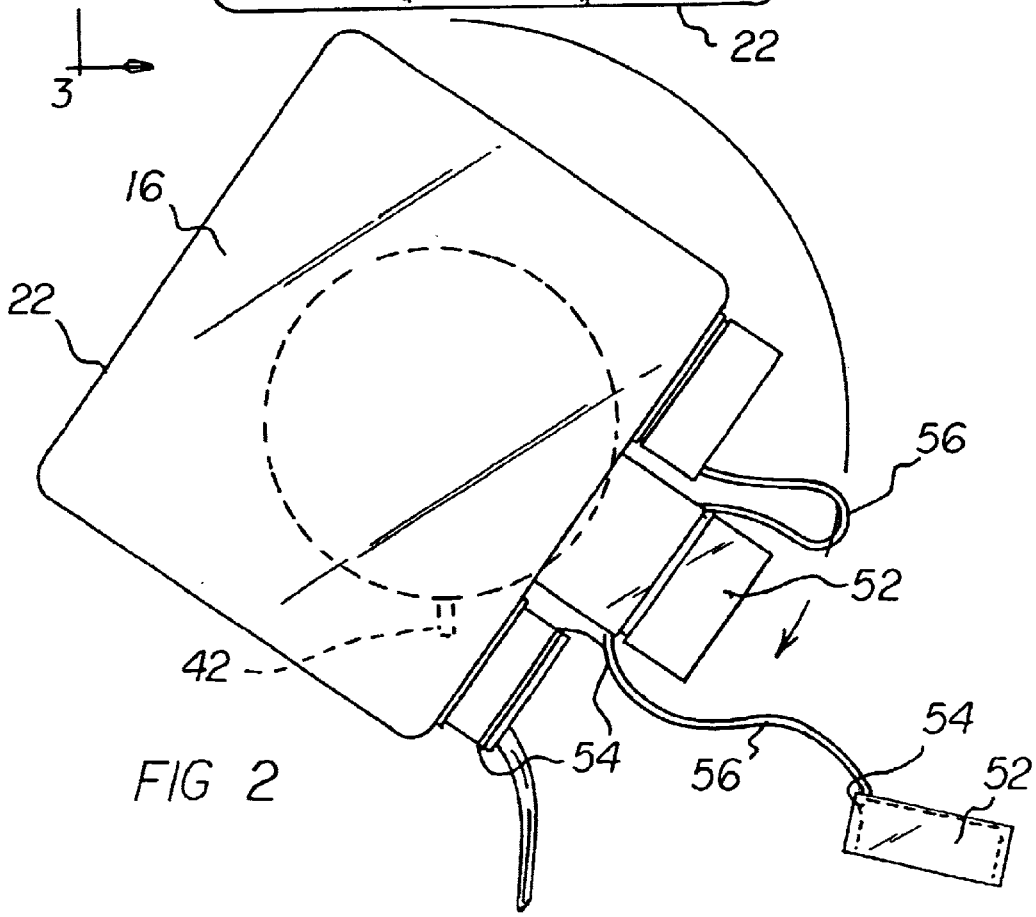
FIG 2

FLUID DISPENSING SYSTEM

BACKGROUND OF THE INVENTION

1. Field of the Invention

The present invention relates to a fluid dispensing system and more particularly pertains to dispensing personal bath products in a sanitary, efficient and convenient manner.

2. Description of the Prior Art

The use of liquid dispensing mechanisms of known designs and configurations is known in the prior art. More specifically, liquid dispensing mechanisms of known designs and configurations previously devised and utilized for the purpose of dispensing liquids through conventional methods and apparatuses are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, they do not describe a fluid dispensing system that allows dispensing personal bath products in a sanitary, efficient and convenient manner.

In this respect, the fluid dispensing system according to the present invention substantially departs from the conventional concepts and designs of the prior art, and in doing so provides an apparatus primarily developed for the purpose of dispensing personal bath products in a sanitary, efficient and convenient manner.

Therefore, it can be appreciated that there exists a continuing need for a new and improved fluid dispensing system which can be used for dispensing personal bath products in a sanitary, efficient and convenient manner. In this regard, the present invention substantially fulfills this need.

SUMMARY OF THE INVENTION

In view of the foregoing disadvantages inherent in the known types of liquid dispensing mechanisms of known designs and configurations now present in the prior art, the present invention provides an improved fluid dispensing system. As such, the general purpose of the present invention, which will be described subsequently in greater detail, is to provide a new and improved fluid dispensing system and method which has all the advantages of the prior art and none of the disadvantages.

To attain this, the present invention essentially comprises a container. The container is fabricated of a semi-rigid waterproof plastic material. The container has a planar rear wall and a parallel planar front wall. Each wall is rectangular in configuration with an inner surface and an outer surface. Each wall has a top edge and a bottom edge and two parallel side edges there between. A suction cup mounting aperture is provided on the outer surface of the rear wall located equally spaced from the side edges and closer to the top edge than the bottom edge so as to distribute the weight of the container in a downward direction. The aperture has a diameter of between about 0.2 and 0.4 inches in diameter. The container also has two parallel side walls. Each side is rectangular in configuration. Each has an inner surface and an outer surface with a top edge and a bottom edge and two parallel side edges there between. Each side wall is perpendicular to the front wall and rear wall with the side edges of the side walls coupling with the side edges of the front and rear walls. In this manner a rectilinear hollow tube is formed. The holder also has a planar bottom wall perpendicular to front, rear and side walls. The bottom wall has an inner surface and an outer surface with four edges there between. The four edges couple with the bottom edges of the front, rear and side walls thereby closing the lower edge of the tube and forming a chamber within the walls. The top edges of the front, rear and side walls form an opening into the chamber. Two parallel divider walls are mounted within the chamber parallel with, and spaced equally from, each other and the side walls to thereby form three fluid receiving zones. A central fluid receiving zone and two side receiving zones adjacent to the side walls are provided. The divider walls each have upper edges and lower edges coupled to the bottom wall and side edges coupled to the front and rear walls. A suction cup is next provided. The suction cup is fabricated of a flexible elastomeric waterproof plastic material. The suction cup has a mounting portion and a suction portion. The mounting portion has an inner enlargement and an outer enlargement. The mounting portion also has a cylindrical region between the inner enlargement and the outer enlargement in rotatable contact with the aperture and sized to rotatably couple with, and be held securely within, the aperture of the outward rear wall of the container. The suction portion has a generally concave configuration. The suction portion has an outer periphery of between about 2 and 3 inches. This configuration facilitates a holding-suction force when the suction cup is pressed onto a flat surface such as a shower wall. The periphery also has a small tab for facilitating the removal of the suction cup from a supporting surface. A top wall is next provided. The top wall has side edges coupled to the top edges of the front, rear and side walls and centrally coupled to the top edges of the divider walls. The top wall has a tubular extension. The tubular extension has male snapping regions above the side fluid receiving zones adjacent to the side edges of the container. The top wall also has a central rectilinear extension above the central fluid receiving zone. The rectilinear extension has a tubular extension with a male snapping region above the central fluid receiving zone. Next provided are a plurality of container caps fabricated of a waterproof semi-rigid plastic material. The container caps are of a round tubular hollow configuration. Internal female snapping regions allow the cap to be removably received and held on the container. The caps include side caps over the side fluid receiving zones and a central cap over the central fluid receiving zone. Lastly, two cap links are provided. The cap links are fabricated of a flexible, waterproof plastic material. Each link has a first end coupled to the outside surface of one side of the cap. Each link also has a second end coupled to the extension so as to maintain the side caps within the proximity of the container even when removed from the container during operation of the system.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved fluid dispensing system which has all of the advantages of the prior art liquid dispensing mechanisms of known designs and configurations and none of the disadvantages.

It is another object of the present invention to provide a new and improved fluid dispensing system which may be easily and efficiently manufactured and marketed.

It is further object of the present invention to provide a new and improved fluid dispensing system which is of durable and reliable constructions.

An even further object of the present invention is to provide a new and improved fluid dispensing system which is susceptible of a low cost of manufacture with regard to both materials and labor, and which accordingly is then susceptible of low prices of sale to the consuming public, thereby making such fluid dispensing system economically available to the buying public.

Even still another object of the present invention is to provide a fluid dispensing system for dispensing personal bath products in a sanitary, efficient and convenient manner.

Lastly, it is an object of the present invention to provide a new and improved fluid dispensing system. A container in a generally rectilinear configuration has a plurality of fluid receiving zones provided within the walls. At least one suction cup has a mounting portion coupled to the rear wall of the container and a suction portion to facilitate a holding suction force upon the pressing of the suction cup onto a flat surface. A top wall has side edges coupled to the top edges of the front, rear and side walls and with coupling regions above the fluid receiving zones. A plurality of container caps with internal female coupling regions allow the cap to be removably received and held on the container. Cap links have a first end coupled to the caps and a second end coupled to the container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a liquid dispensing system constructed in accordance with the principles of the present invention.

FIG. 2 is a view similar to FIG. 1 but showing the system in a tipped orientation for pouring.

The same reference numerals refer to the same parts throughout the various Figures.

DESCRIPTION OF THE PREFERRED EMBODIMENT

Figure 3:
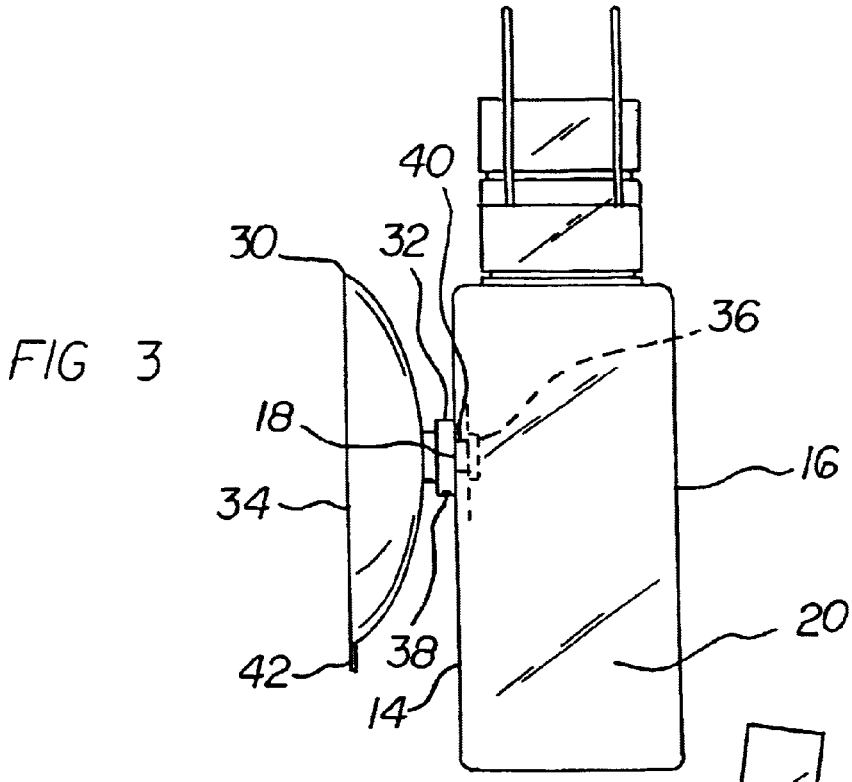
FIG. 3 is a side elevational view of the system shown in FIGS. 1 and 2.

With reference now to the drawings, and in particular to FIG. 1 thereof, the preferred embodiment of the new and improved fluid dispensing system embodying the principles and concepts of the present invention and generally designated by the reference numeral 10 will be described.

The present invention, the fluid dispensing system 10 is comprised of a plurality of components. Such components in their broadest context include a container, at least one suction cup, a top wall, a plurality of container caps and cap links. Such components are individually configured and correlated with respect to each other so as to attain the desired objective.

First provided is a container 12. The container is fabricated of a semi-rigid waterproof plastic material. The container has a planar rear wall 14 and a parallel planar front wall 16. Each wall is rectangular in configuration with an inner surface and an outer surface. Each wall has a top edge and a bottom edge and two parallel side edges there between. A suction cup mounting aperture 18 is provided on the outer surface of the rear wall located equally spaced from the side edges and closer to the top edge than the bottom edge so as to distribute the weight of the container in a downward direction. The aperture has a diameter of between about 0.2 and 0.4 inches in diameter. The container also has two parallel side walls 20. Each side is rectangular in configuration. Each has an inner surface and an outer surface with a top edge and a bottom edge and two parallel side edges there between. Each side wall is perpendicular to the front wall and rear wall with the side edges of the side walls coupling with the side edges of the front and rear walls. In this manner a rectilinear hollow tube is formed. The holder also has a planar bottom wall 22 perpendicular to front, rear and side walls. The bottom wall has an inner surface and an outer surface with four edges there between. The four edges couple with the bottom edges of the front, rear and side walls thereby closing the lower edge of the tube and forming a chamber 24 within the walls. The top edges of the front, rear and side walls form an opening into the chamber. Two parallel divider walls 26 are mounted within the chamber parallel with, and spaced equally from, each other and the side walls to thereby form three fluid receiving zones 28. A central fluid receiving zone and two side receiving zones adjacent to the side walls are provided. The divider walls each have upper edges and lower edges coupled to the bottom wall and side edges coupled to the front and rear walls.

A suction cup 30 is next provided. The suction cup is fabricated of a flexible elastomeric waterproof plastic material. The suction cup has a mounting portion 32 and a suction portion 34. The mounting portion has an inner enlargement 36 and an outer enlargement 38. The mounting portion also has a cylindrical region 40 between the inner enlargement and the outer enlargement in rotatable contact with the aperture and sized to rotatably couple with, and be held securely within, the aperture of the outward rear wall of the container. The suction portion has a generally concave configuration. The suction portion has an outer periphery of between about 2 and 3 inches. This configuration facilitates a holding suction force when the suction cup is pressed onto any of a wide variety of flat surfaces such as a wall, shower wall, or the like. The periphery also has a small tab 42 for facilitating the removal of the suction cup from a supporting surface.

A top wall 44 is next provided. The top wall has side edges coupled to the top edges of the front, rear and side walls and centrally coupled to the top edges of the divider walls. The top wall has a tubular extension 46. The tubular extension has male snapping regions above the side fluid receiving zones adjacent to the side edges of the container. The top wall also has a central rectilinear extension 48 above the central fluid receiving zone. The rectilinear extension has a tubular extension 50 with a male snapping region above the central fluid receiving zone.

Next provided are a plurality of container caps 52 fabricated of a waterproof semi-rigid plastic material. The container caps are of a round tubular hollow configuration. Internal female snapping regions 54 allow the cap to be removably received and held on the container. The caps include side caps over the side fluid receiving zones and a central cap over the central fluid receiving zone.

Lastly, two cap links 56 are provided. The cap links are fabricated of a flexible, waterproof plastic material. Each link has a first end coupled to the outside surface of one side of the cap. Each link also has a second end coupled to the extension so as to maintain the side caps within the proximity of the container even when removed from the container during operation of the system.

In an alternate embodiment of the invention the container is formed as a unitary component with divider walls there within to form a plurality of separate fluid dispensing zones.

Figure 4:
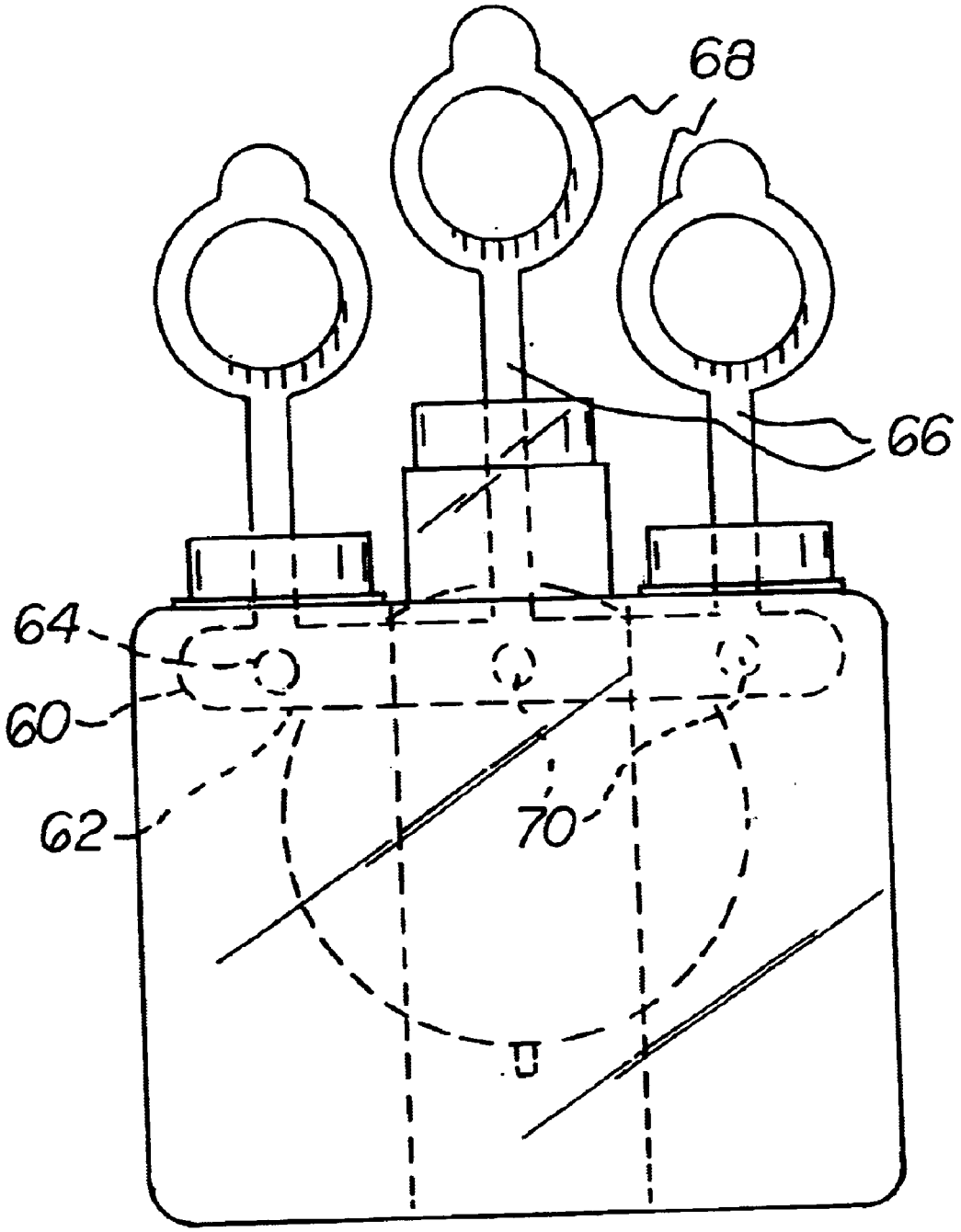
FIG. 4 is a front elevational view of the system of the prior Figures but with an alternate embodiment for removably securing the caps to the container.

In another embodiment, shown in FIG. 4, a cap support assembly 60 is provided. Such assembly includes a base 62 at a lower extent. Laterally spaced apertures 64 are provided through the base. Flexible fingers 66 extend upwardly and are secured to the caps 68. Further included are projections 70 projecting from the container for removably receiving the apertures of the base.

Figure 5:
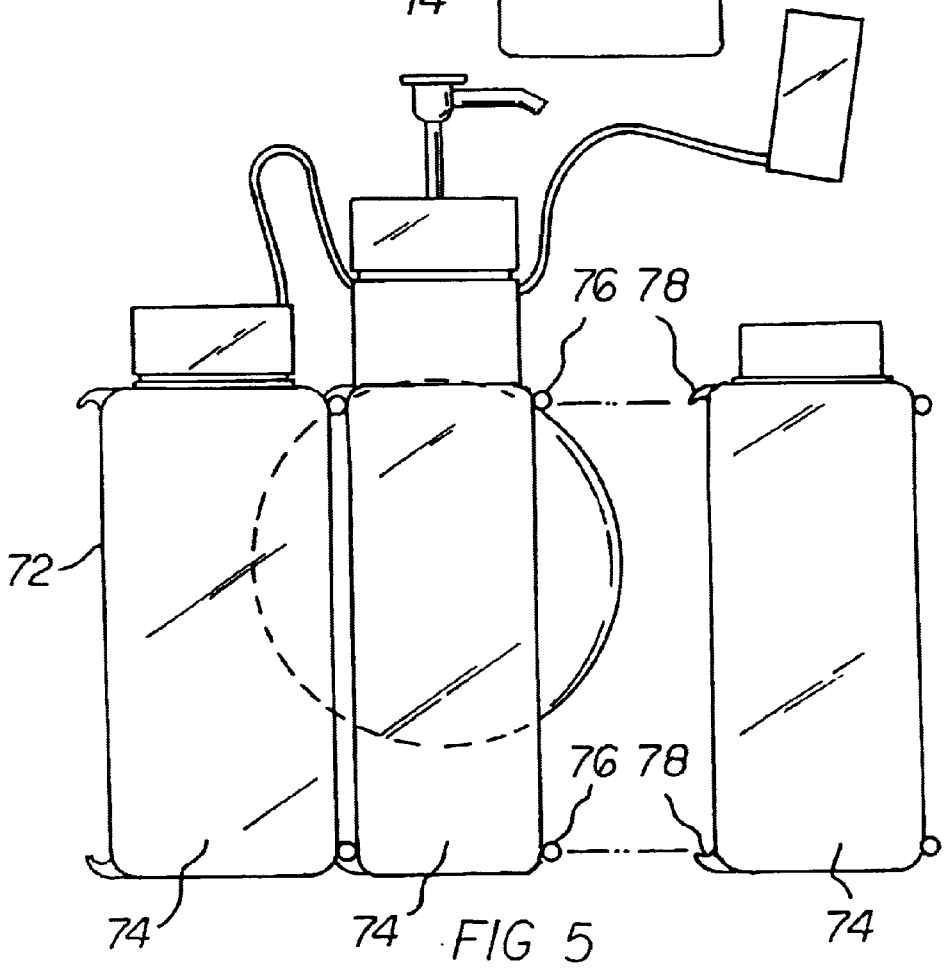
FIG. 5 is a front elevational view of an alternate embodiment of the invention wherein the fluid containers are separable one from the other and with a pump associated therewith.

In still another alternate embodiment, shown in FIG. 5, the container is an enlarged composite container 72 formed of a plurality of separable smaller containers 74. In this embodiment each of the smaller containers have a plurality of exterior male projections 76 and a plurality of exterior female projections 78. In this manner a plurality of smaller containers may be removably coupled together through the projections to form the composite container for supporting a plurality of fluids in a plurality of fluid dispensing zones.

Figure 6:
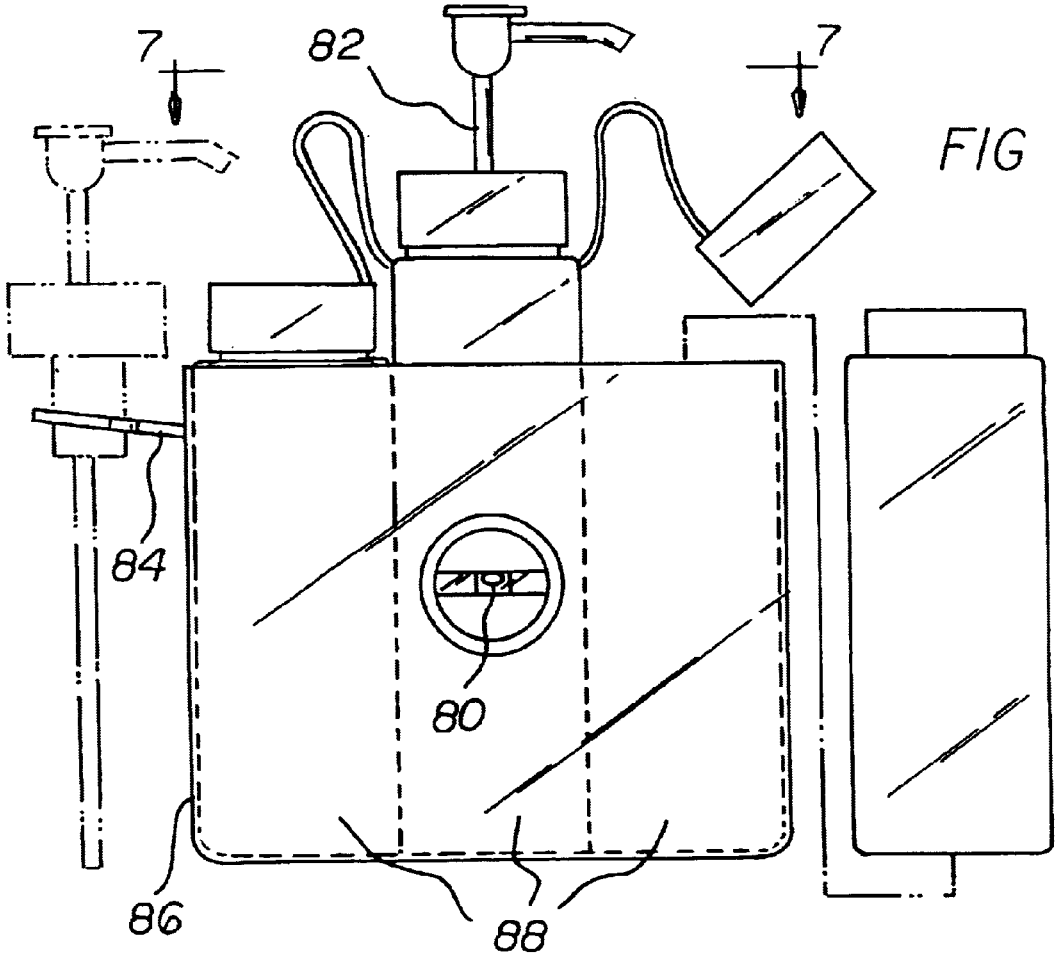
FIG. 6 a view similar to FIG. 5 but showing the system with fingers for supporting the pump and also with a spirit level.

In yet another embodiment, shown in FIG. 6, a spirit level 80 is provided. The spirit level is secured to the front face of the front wall.

In still another embodiment, shown in FIGS. 5 and 6, a pump 82 is provided. The pump is positionable in at least one of the fluid receiving zones.

Figure 7:
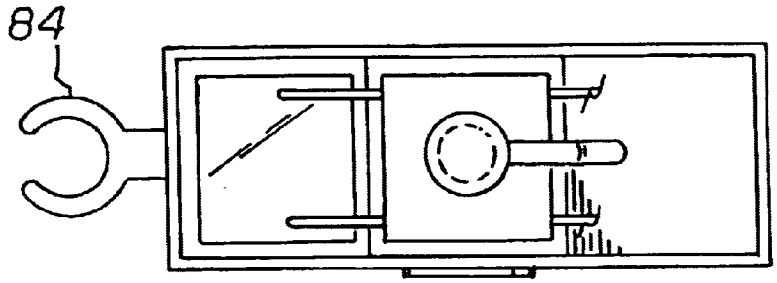
FIG. 7 is a plan view of the system taken along line 7—7 of FIG. 6.

In another embodiment, shown in FIGS. 6 and 7, a c-shaped holder 84 is provided. The holder removably receives the pump.

In a further embodiment, also shown in FIGS. 6 and 7, the container is formed of an enlarged reception area 86. In this embodiment, the container includes a plurality of separable smaller containers 88. Each of the smaller containers are removably received in the enlarged reception area to form a composite container for supporting a plurality of fluids in a plurality of fluid dispensing zones.

Figure 8:
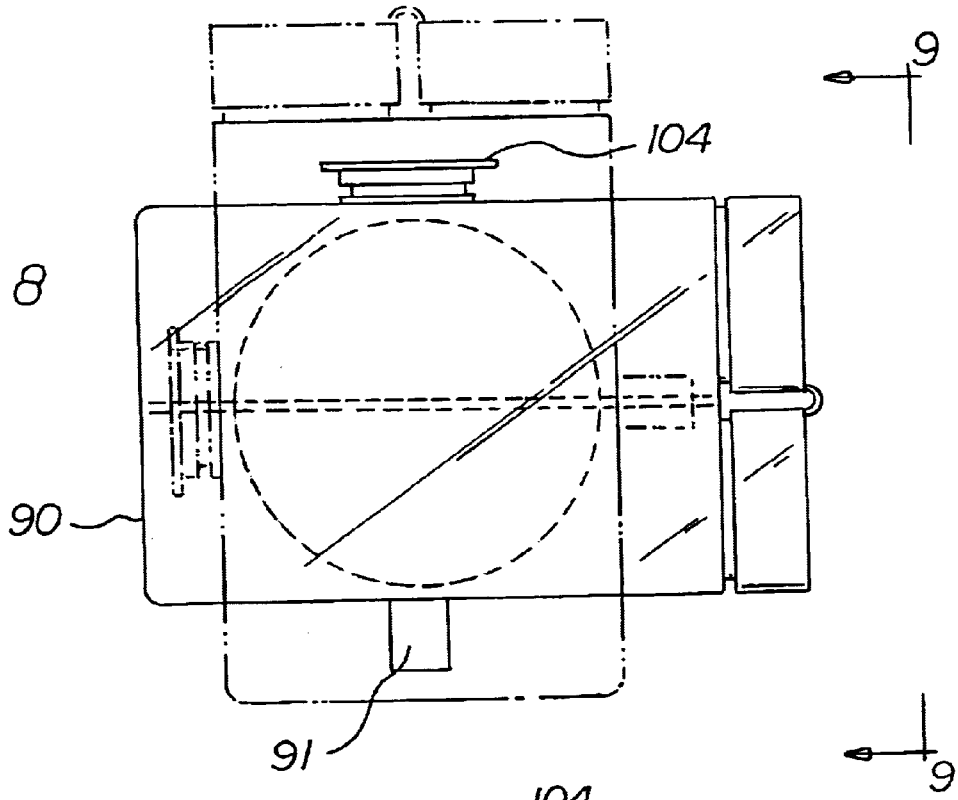
FIG. 8 is a plan view of another alternate embodiment of the invention wherein the fluid containers is coupled to a soap dish.
Figure 9:
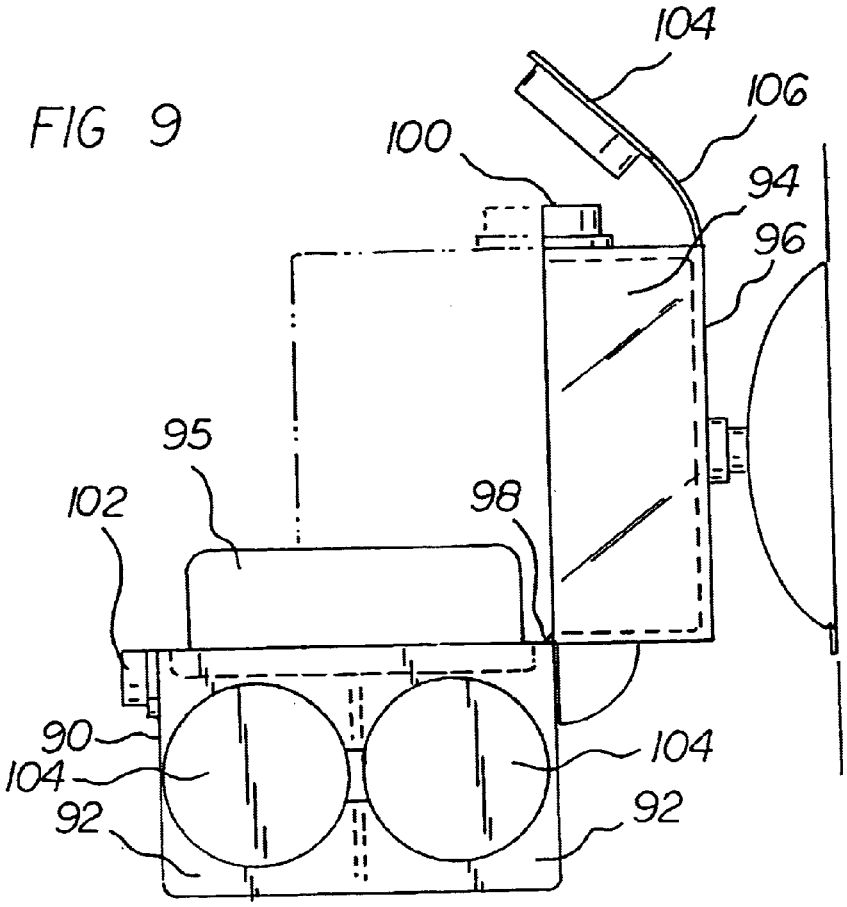
FIG. 9 is a side elevational view taken along line 9—9 of FIG. 8.

In a final alternate embodiment, shown in FIGS. 8 and 9, the container is formed of an enlarger reception area 90. The container has a plurality of liquid dispensing zones 92 and further includes a rectilinear receptacle 94 for a bar of soap 95. The receptacle has an exterior face 96 with a suction cup rotatably coupled thereto. The receptacle also has a free edge with a hinge 98 coupled to the container with complimentary projections 100, 102 on the container and the receptacle. A removable cap 104 is positionable over the projections. A stop 91 is provided, as shown in FIGS. 8 and 9, which limits the opening of the soap receptacle to about 90 degrees. Finally, a flexible strap 106 couples the cap and the receptacle. In this manner, when the receptacle is separated from the container it forms a shelf for supporting a bar of soap.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A fluid dispensing system comprising:

a container in a generally rectilinear configuration having a planar rear wall and parallel front wall with a top edge and a bottom edge and two parallel side edges there between, the container also having a planar bottom wall with a plurality of fluid receiving zones within the walls;

at least one suction cup having a mounting portion coupled to the rear wall of the container and a suction portion to facilitate a holding suction force upon the pressing of the suction cup onto a flat surface, the suction cup allowing a rotation to allow a user to tip the containers;

a top wall having side edges coupled to the top edges of the front, rear and side walls and with coupling regions above the fluid receiving zones;

a plurality of container caps with internal female coupling regions allowing the cap to be removably received and held on the container; and cap links having a first end coupled to the caps and a second end coupled to the container.

2. The system as set forth in claim 1 wherein the container is a unitary component with divider walls there within to form a plurality of separate fluid dispensing zones.

3. The system as set forth in claim 1 and further including a cap support assembly, such assembly including a base at a lower extent and with laterally spaced apertures through the base and with flexible fingers extending upwardly secured to the caps and further including projections extending from the container for removably receiving the apertures of the base.

4. The system as set forth in claim 1 wherein the container is an enlarged composite container formed of a plurality of separable smaller containers with each of the smaller containers having a plurality of exterior male projections and a plurality of exterior female projections, whereby a plurality of smaller containers may be removably coupled together through the projections to form the composite container for supporting a plurality of fluids in a plurality of fluid dispensing zones.

5. The system as set forth in claim 1 and further including a spirit level secured to the front face of the front wall.

6. The system as set forth in claim 1 and further including a pump positionable in at least one of the fluid receiving zones.

7. The system as set forth in claim 5 and further including a c-shaped holder for removably receiving the pump.

8. The system as set forth in claim 1 wherein the container is formed of an enlarged reception area and further including a plurality of separable smaller containers with each of the smaller containers removably received in the enlarged reception area to form composite container for supporting a plurality of fluids in a plurality of fluid dispensing zones.

9. The system as set forth in claim 1 wherein the container is formed of an enlarger reception area with a plurality of liquid dispensing zones and further including a rectilinear receptacle for a bar of soap, the receptacle having an exterior face and a free edge with a hinge and a stop coupled to the container with coupling components between the container and the receptacle.

* * * * *